United States Patent [19]

Markson

[11] Patent Number: 4,462,636

[45] Date of Patent: Jul. 31, 1984

[54] FOOTSTOOL

[75] Inventor: Morley Markson, Toronto, Canada

[73] Assignee: Yorkvest Limited, Toronto, Canada

[21] Appl. No.: 318,513

[22] Filed: Nov. 5, 1981

[51] Int. Cl.[3] ..... A47C 9/12

[52] U.S. Cl. ..... 297/439; 108/128; 108/131; 108/132; 297/438; 297/461

[58] Field of Search ..... 297/194, 439, 438, 461; 108/132, 131, 130, 133, 115, 128, 160

[56] References Cited

U.S. PATENT DOCUMENTS

| | | | |
|---|---|---|---|
| 1,823,871 | 9/1931 | Beasley | 108/132 |
| 2,817,567 | 12/1957 | Shepherdson | 108/132 |
| 2,913,295 | 11/1959 | Park | 108/160 |
| 3,271,075 | 9/1966 | Good | 297/439 |
| 4,010,696 | 3/1977 | Priesman | 108/132 |
| 4,383,488 | 5/1983 | Macho et al. | 108/130 X |

FOREIGN PATENT DOCUMENTS

| | | | |
|---|---|---|---|
| 2829691 | 4/1980 | Fed. Rep. of Germany | 297/439 |

*Primary Examiner*—James T. McCall

*Attorney, Agent, or Firm*—Rogers, Bereskin & Parr

[57] ABSTRACT

A collapsible footstool is disclosed and includes a platform and a pair of legs adapted to support the platform in an elevated position. The legs are hinged to the platform so that they can be folded inwardly below the platform and stop means are provided for preventing outward movement of the legs beyond positions in which they support the platform. Bracing means are also provided and include respective struts pivotally coupled to the underside of the platform and adapted to co-operate with the legs for bracing them in their operative positions.

9 Claims, 7 Drawing Figures

FOOTSTOOL

This invention relates generally to footstools and has been devised primarily with the aim of providing a footstool which can be used as an aid to achieving a proper sitting posture.

It is well recognized that physical discomfort in the lower spine area in humans often derives from improper sitting posture, and that such discomfort can sometimes be prevented or alleviated if a person is encouraged to sit with the feet raised. This has the effect of promoting proper relative orientation between the pelvis and the spinal column. The use of a small footstool or ottoman often assists in achieving the required orientation. However, footstools are generally not available outside the home and it is believed that a need exists for a footstool which is collapsible and readily transportable. As far as is known, the prior art fails to disclose a footstool which would fulfill this need.

Applicant is aware of the following Canadian Pat. Nos. which disclose prior art footstools and the like:

| | | | |
|---|---|---|---|
| 94,128 | (Heartley) | 625,221 | (Gleitsman et al.) |
| 99,048 | (Sherman) | 625,222 | (Fuerst) |
| 209,726 | (Walker) | 635,454 | (Gleitsman) |
| 231,750 | (Devenish) | 635,455 | (Gleitsman et al.) |
| 246,623 | (Metcalfe et al.) | 755,906 | (Raeder) |
| 248,745 | (Josselyn et al.) | 897,580 | (Kobiella) |
| 501,978 | (Enge) | 951,631 | (Pinkas) |
| 618,075 | (Fuerst) | | |

The footstool provided by the invention includes a platform having an upper, foot-supporting surface and a pair of legs adapted to support the platform in an elevated position above a surface on which the footstool is disposed. Hinge means are provided coupling the legs to the platform at positions spaced along the platform. The hinge means permit movement of the legs between operative positions in which the legs extend outwardly from the platform for supporting the same, and inoperative positions in which the legs are folded inwardly below the platform. The platform and legs are shaped to define a generally flat configuration when the legs are folded inwardly. Stop means and bracing means are also provided. The stop means prevent outward movement of the legs beyond their operative position and the bracing means maintain the legs in their operative positions against the stop means. The bracing means include a strut associated with each leg. The strut is pivotally coupled adjacent a first end thereof to the platform and has a second, distal end co-operable with the relevant leg for bracing the leg in its operative position. The strut is pivotable about its first end between a leg bracing position and an inoperative position in which the leg is permitted to fold inwardly against the platform.

It has been found that the footstool can be constructed in a relatively compact and lightweight form in which it is readily transportable in a collapsed position, for example, in a carrying pouch or even in a pocket purse but that the footstool can at the same time be sturdy when erected.

In order that the invention may be more clearly understood, reference will now be made to the accompanying drawings which illustrate a preferred embodiment of the invention by way of example, and in which.

Figure 1:
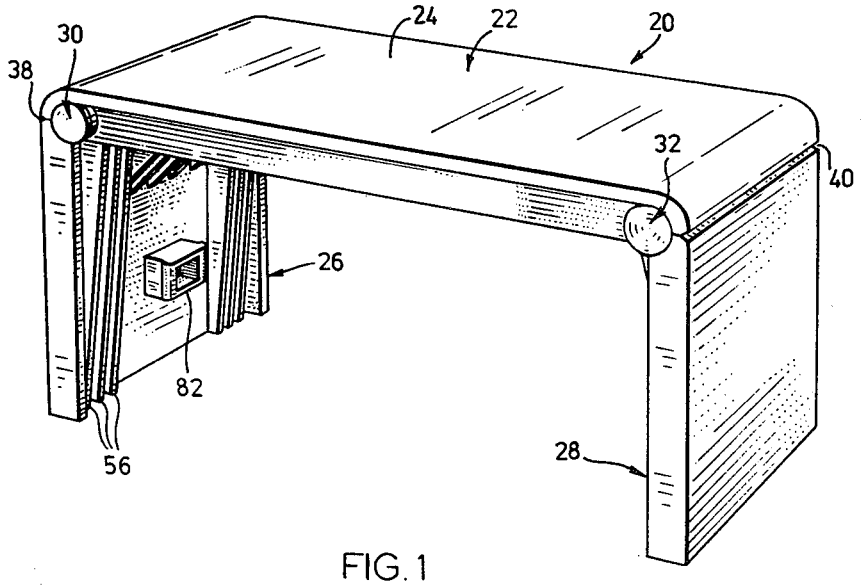
FIG. 1 is a perspective view from above and one side of a footstool according to the invention.
Figure 2:
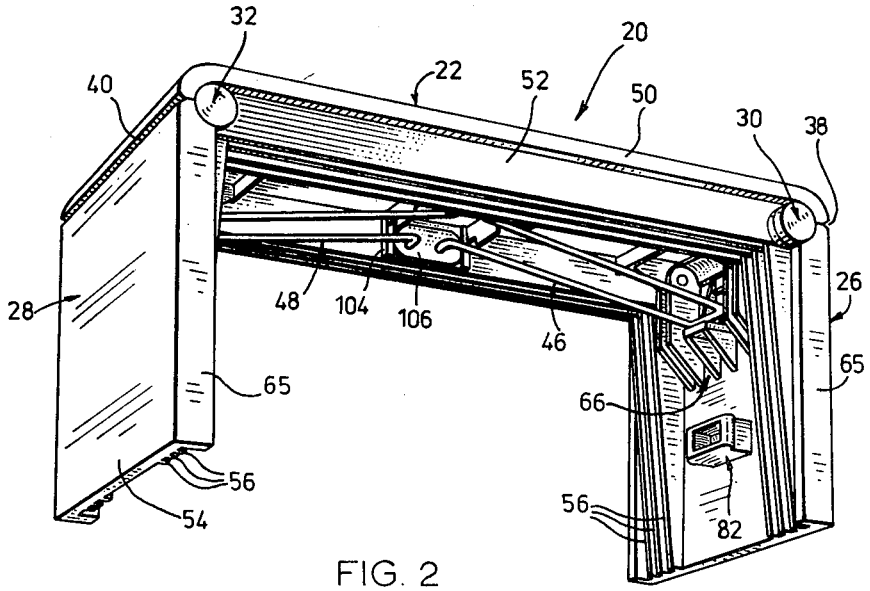
FIG. 2 is a perspective view from below and the opposite side corresponding to FIG. 1.
Figure 3:
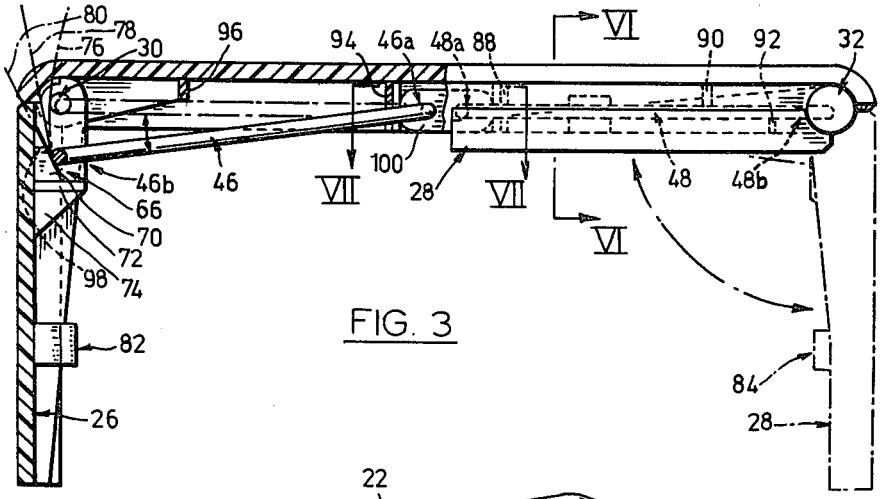
FIG. 3 is a side elevational view of the erected footstool, partly in section.
Figure 4:
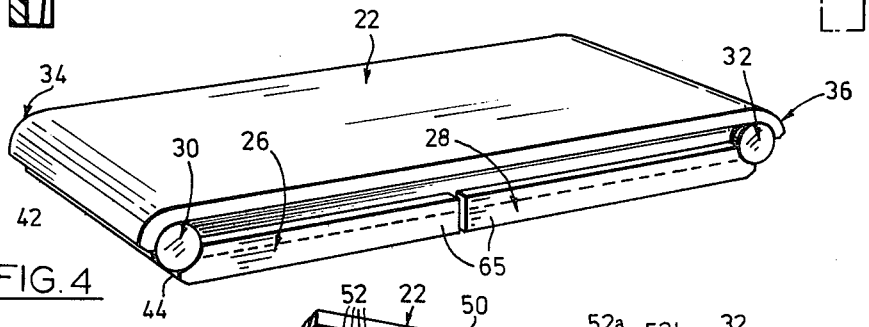
FIG. 4 is a perspective view of the footstool in its collapsed configuration.

Referring first to FIGS. 1 and 2, reference numeral 20 denotes a footstool comprising a platform 22 having an upper, foot-supporting surface 24 and a pair of legs 26 and 28 capable of supporting the platform in an elevated position above a surface on which the footstool is disposed. The legs are coupled to respectively opposite ends of the platform by hinges generally indicated at 30 and 32. One of the hinges is shown partly exploded in FIG. 5 and that view will be described later. For the present, it is sufficient to note that the hinges permit the legs to move between operative positions as shown in FIGS. 1 to 3, in which the legs extend outwardly from the platform and inoperative positions in which the legs are folded inwardly below the platform as shown in FIG. 4.

It will also be seen from that view that the platform and legs are shaped to define a generally flat and relatively compact configuration when the legs are folded inwardly. The intention is that the footstool shall be easily and conveniently transportable in its collapsed configuration, for example in a carrying pouch (not shown) or in the pocket or purse of the person using the footstool. By way of illustration and without limiting the invention, the footstool may have the following approximate dimensions when in its collapsed configuration: length 8.5 inches, width 4.4 inches, depth 0.8 inches. The ends of the platform 22 are radiussed as indicated at 34 and 36 to provide a smooth contour for easy pocketability. Also, opposed edges between the ends of platform 22 and the legs 28 are chamfered as indicated at 38 and 40 to minimize the risk of pinching, say, a person's fingers or clothing or other material between the legs and platform when the legs are moved to their operative positions. The edges themselves are indicated at 42 and 44 in FIG. 4 at the lefthand end of the footstool as seen in FIG. 1 (corresponding edges at the opposite end of the footstool have not been specifically indicated by reference characters). It will be seen from FIG. 1 that these opposed edges co-operate when the legs are moved to their operative positions to define respective stops for preventing outward movement of the legs beyond their operative position.

The legs are maintained in their operative positions by a bracing arrangement which urges the legs against the respective stops defined by these abutting edges of the platform and legs. The bracing arrangement comprises respective struts 46 and 48 associated one with each of the legs 26 and 28. Each strut is pivotally coupled adjacent a first end thereof, denoted by the suffix "a", to the underside of the platform 22 and has a second, distal end, denoted by suffix "b" which co-operates with the relevant leg for bracing the leg in its operative position. Each strut is pivotable about its first end (46*a* or 48*a*) between a leg bracing position and an inoperative position in which the leg can fold inwardly against the platform. Both struts are shown in their leg bracing positions in FIG. 2 while in FIG. 3, strut 46 is shown in this position while strut 48 is shown in dotted outline in the inoperative position against the underside of the platform 22, with the associated leg 28 folded inwardly against the platform.

In this particular embodiment, each strut 46, 48 is in fact in the form of a U-shaped length of wire, the ends of which are turned outwardly to form pivot points, while the base of the U forms the distal end of the strut which co-operates with the leg. The struts are made of relatively heavy gauge wire so that they tend to fall down under gravity into their leg bracing positions when the legs are hinged outwardly with the platform disposed so that its foot-supporting surface 24 is uppermost as shown in FIG. 1.

Each of the legs 26 and 28 and the platform 22 is moulded in a plastic material having the characteristics of light weight combined with relatively high strength. In this particular embodiment, a rigid ABS plastic was used although there is no limitation to this particular material. As can best be seen by reference to FIG. 5, each moulding includes a generally flat base member and a plurality of ribs which extend longitudinally of the inner surface of the base member. The base member for platform 22 is denoted by reference numeral 50 and the ribs at the inner surface of that base member are denoted 52. The corresponding base member for leg 26 is denoted 54 and the associated ribs 56. It will also be seen from FIG. 5 that the end edges which co-operate to limit outward movement of the legs (as the edges 42 and 44 in FIG. 4) are defined at the ends of the respective base members of the mouldings. The co-operating edges on platform 22 and leg 28 are denoted respectively 58 and 60 in FIG. 5.

Figure 6:
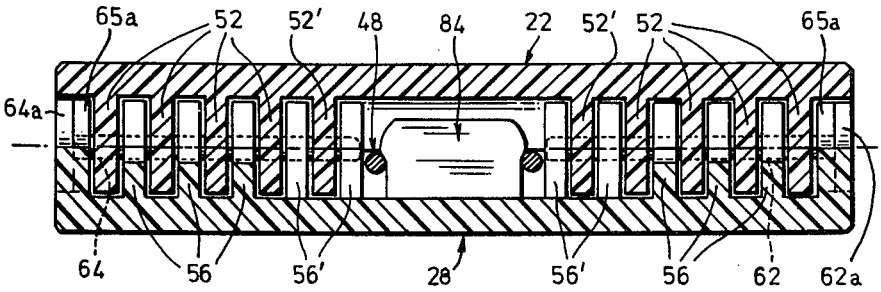

The ribs 52 and 56 are arranged in sets disposed adjacent the side edges of the respective mouldings and the ribs in each set are spaced from one another to permit the ribs of the respective mouldings to fit together in what might be termed "interleaved" relationship. The outer ends of the ribs are rounded as indicated by reference numerals **52*a* and 56*a* respectively and are formed with apertures 52*b* and 56*b* respectively for receiving hinge pins 62 and 64. Thus, the interleaved inner end portions of the ribs 52 and 56 co-operate to form part of the hinge 32 between platform 22 and leg 28. The other leg 26 is correspondingly designed and co-operates with opposite end portions of the ribs on platform 22 to form the other hinge 30. When the legs are folded inwardly, the respective sets of ribs "nest" together as best seen in FIG. 6**. This interleaved arrangement has the advantage of preventing any relative lateral movement between the platform and leg in the folded position of the leg. At the same time, the ribs impart strength to the respective mouldings.

Figure 5:
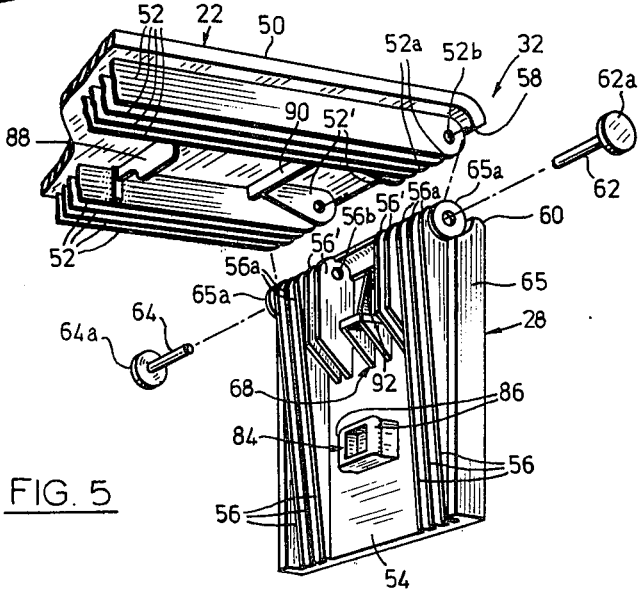
FIG. 5 is an exploded perspective view illustrating the hinge between one of the legs and the platform of the footstool; and, FIGS. 6 and 7 are sectional views taken on the lines denoted respectively VI—VI and VII—VII of FIG. 3.

Certain of these innermost ribs 52 and 56 are shorter than the other ribs, as indicated at 52' and 56' to provide clearance for other parts. Also, the legs 26, 28 have respective outer ribs or flanges 65 (FIG. 4) which overlie the outer platform ribs 52 for ease of gripping when the leg is opened from its folded position. Each flange 65 has an integral disc shaped formation **65*a* (FIG. 5) at its inner end which forms part of the hinge between the relevant leg and the platform. The two formations 65*a* as seen in FIG. 5 are disposed outwardly of the outermost platform ribs 52 when the footstool is assembled and have apertures aligned with apertures 56*b***.

The hinge pins 62 and 64 are also plastic mouldings and have flat and smooth disc-shaped heads **62*a* and 64*a* respectively which overlie the formations 65*a* in the assembled footstool and which are visible at the exterior of the footstool as can be seen from FIGS. 2 and 4. The pins are inserted from respectively opposite sides of the assembled platform/leg combination first through the formations 65*a* and are held in place by a small amount of adhesive which secures the inner end of each pin to the innermost rib in each of the sets 56 (see FIG. 6**).

Each of the leg mouldings 26, 28 also includes a ramp structure for co-operation with the bracing strut (46 or 48) associated with that leg. The ramp structure of leg 26 is visible in FIG. 3 and is denoted reference numeral 66; the corresponding structure for leg 28 can be seen in FIG. 5 and is denoted by reference numeral 68. It will be seen from that view that the ramp structure is positioned between the two sets of ribs 56 of leg 28. Referring to ramp structure 66 (FIG. 3) as typical of both ramp structures, it will be seen that the structure includes a pair of triangular shaped ramp members 70 having inclined edges positioned to co-operate with the distal end of strut 46. The two members are in fact spaced by an amount slightly less than the width of the end of the strut so as to define spaced bearing surfaces for the strut as can best been seen in FIG. 2 in the case of ramp structure 66.

Referring back to FIG. 3, immediately below the two ramp members 70 is a ledge 72 which protrudes from the base member of leg 26 generally normal thereto and which forms a stop at the bottom of the ramp members 70. Below the ledge are two supporting fillets 74.

Strut 46 is shown in a typical position it would occupy when leg 26 is fully extended and the strut is in its operative position. Thus, starting from the collapsed position of FIG. 4, if leg 26 is hinged outwardly to the position of FIG. 3, strut 46 will drop by gravity generally into the position shown in FIG. 3 and will frictionally engage the ramp member 70 at a position approximately intermediate the ends of the inclined surfaces of the members. The precise point of engagement is not critical and the ramp members are in fact designed (as explained in the following paragraph) to allow for variations in manufacturing tolerances so that the strut can in effect lock at any position along the members. However, it is intended that this should take place at a position above ledge 72.

The ramp structures 66 and 68 are specifically designed so that the inclined outer edges of the ramp members (as members 70) are disposed at a slight inclination outwardly of a tangent to the arc described by the outer end of the associated bracing strut as it moves between its inoperative position and its bracing position. By way of example, in FIG. 3, that arc is denoted by reference numeral 76 and a tangent to that arc is denoted 78. The inclined edges of the ramp members 70 are disposed in a plane 80 which is outwardly of the tangent 78. By way of example, the angle between the tangent and the line on which the outer edge of the ramp lies may be of the order of 10°.

The leg mouldings also include respective detents, denoted 82 and 84 for securing the legs in their folded positions. The two detents are visible in perspective in FIGS. 2 and 5 respectively. Referring to FIG. 5 by way of example, it will be seen that detent 84 takes the form of a hollow, generally rectangular shaped projection which extends outwardly from the inner face of the base member 54 of leg 28. The side faces of detent 84 are provided adjacent their outer ends with respective longitudinally extending ribs or projections 86 and the detent is dimensioned so that the projections are slightly wider than the space between the side limbs of the U-shaped strut 46. The design of the strut is such that the limbs can spread apart slightly to snap over the ribs 86 when leg 28 is moved to its folded position. Leg 28 is shown in this position in FIG. 3 with the detent fitted between the limbs 48. At the same time, the strut is held against upward movement (towards the base member of platform 22) by two ribs 88 and 90 which extend transversely of platform 22 between the respective sets of innermost longitudinal ribs 52. The ribs 88 and 90 are visible in dotted outline in FIG. 3 and in perspective in FIG. 5 and it will be seen from FIG. 3 that the strut 48 lies in contact with the outer surfaces of the ribs when the strut is in its inoperative position. A further transverse rib 92 is provided between the ramp members of ramp structure 68 and acts on the strut from its lower side so that the rib is in fact located from both above and below and is prevented from moving. Rib 92 is visible in dotted outline in FIG. 3 and is partly visible within the ramp structure 68 in FIG. 5.

Ribs corresponding to ribs 88, 90 and 92 are of course provided for co-operation with strut 46 and are denoted respectively by the reference numerals 94, 96 and 98 in FIG. 3.

Figure 7:
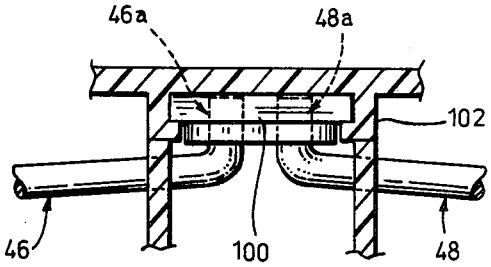

FIG. 7 is a sectional view on line VII—VII of FIG. 3 and shows the manner in which the struts 46, 48 are pivotally coupled to the platform 22. Only one side of the inner end portion of each strut is visible in FIG. 7 although the other side is coupled in similar fashion. It will be seen that the respective struts include laterally deflected end portions which pass through openings in a support member 100 (see also FIG. 3) secured by adhesive within a housing 102 formed on the relevant inner rib at the underside of platform 22. A corresponding housing is of course provided to receive the strut at the other side of the platform and is visible in FIG. 2. The housing is denoted 104 and receives a support 106 similar to support 100.

It will of course be appreciated that the preceding description relates to a preferred embodiment of the invention only and that many modifications are possible within the broad scope of the invention. For example, it would be possible to provide anti-slip ribs or other formations on the foot supporting surface 24 of platform 22 instead of having a smooth surface as shown. Many other changes in the form of the platform and legs are of course possible. Instead of having solid legs as shown, each leg could be replaced by some other form of leg structure which need not necessarily be solid. The bracing means provided for securing the legs in their platform supporting position could also be changed. Struts other than of the form shown could also of course be used.

The detent structures 82 and 84 are not essential although it is preferred to provide some means for retaining the legs in their inwardly folded positions. For example, formations could be provided on the leg for frictional engagement with corresponding formations on the platform itself. Where strut-engaging detents are provided, they need not be of the form shown. Finally, other forms of hinge and other forms of stop means could of course be employed.

I claim:

1. A footstool comprising:

a platform having an upper, foot supporting surface;

a pair of legs adapted to support the platform in an elevated position above a surface on which the foot-stool is disposed;

hinge means coupling the legs to the platform at positions spaced along the platform, the hinge means permitting movement of the legs between operative positions in which the legs extend outwardly from the platform for supporting the same, and inoperative positions in which the legs are folded inwardly below the platform, the platform and legs being shaped to define a generally flat configuration when the legs are folded inwardly;

stop means preventing outward movement of the legs beyond said operative positions; and, bracing means capable of maintaining the legs in their operative positions against said stop means, said bracing means comprising, in association with each leg, a ramp structure provided at the inner side of the respective leg and defining an inclined outer surface, and a strut pivotally coupled adjacent a first end thereof to the underside of the platform and having a second, distal end co-operable with the ramp structure of the relevant leg for bracing the leg in said operative position, the strut being pivotal about its said first end between a leg bracing position and an inoperative position in which the leg can fold inwardly against the platform, and the strut and the ramp structure being arranged so that, as the strut moves from its inoperative position to its bracing position, the distal end of the strut initially engages the respective inclined surface at a position intermediate its ends.

2. A footstool as claimed in claim 1, wherein the inclined outer surface of each ramp structure is disposed in a plane inclined outwardly with respect to a tangent to the arc described by the distal end of the strut in pivotting about its first end between said inoperative position and said bracing position.

3. A footstool as claimed in claim 1, wherein each said strut is pivotally coupled to the platform at a position adjacent the centre of the length of the platform and is designed to move under gravity from its operative position to its said initial contact position with the inclined surface of the ramp structure when the associated leg is moved to its outwardly extending position with the footstool platform uppermost.

4. A footstool as claimed in claim 1, wherein each strut comprises a length of wire disposed in a generally U-shaped configuration with outer end portions of the wire angled outwardly and defining pivot points at said first end of the strut, the base of the U-shaped portion of the wire defining said distal end of the strut.

5. A footstool as claimed in claim 4, further comprising means for retaining the legs in said inwardly folded position, and at least one rib on each of said legs extending transversely of the leg and positioned for co-operation with the side limbs of the associated strut and adapted to retain the strut in its inoperative position when the associated leg is folded inwardly.

6. A footstool as claimed in claim 5, wherein said retaining means comprising respective detents on each of said legs, each detent being shaped to frictionally engage said side limbs of the U-shaped strut for retaining the leg in its inwardly folded position.

7. A footstool as claimed in claim 1, wherein each of said legs and said platform comprises a base member and a plurality of ribs extending generally longitudinally of the base member and inwardly of the respective legs and platform, said ribs being spaced from one another and positioned so that the ribs on the legs interleave between the ribs at the underside of the platform when the legs are moved to their inwardly folded positions.

8. A footstool as claimed in claim 7, wherein said hinge means comprises outer end portions of the respective ribs on the platform and legs, and hinge pins extending through aligned openings in the respective ribs for securing the legs and platform together, said ribs being shaped to permit said hinging movement of the legs between their extended positions and inwardly folded positions.

9. A footstool as claimed in claim 7, wherein each of said legs and said platform comprises respective unitary plastic mouldings.

* * * * *